US005997128A

United States Patent [19]

Lou et al.

[11] Patent Number: 5,997,128

[45] Date of Patent: Dec. 7, 1999

[54] TRANSLATIONAL SERVICE STATION FOR IMAGING INKJET PRINTHEADS

[75] Inventors: Damon Lou; Diane R. Wagner; Kyle Halkola, all of San Diego, Calif.

[73] Assignee: Hewlett-Packard Company, Palo Alto, Calif.

[21] Appl. No.: 08/862,952

[22] Filed: May 30, 1997

[51] Int. Cl.[6] ..... B41J 2/165

[52] U.S. Cl. ..... 347/33; 347/29; 347/36; 347/32

[58] Field of Search ..... 347/33, 32, 35, 347/36, 29, 34

[56] References Cited

U.S. PATENT DOCUMENTS

| | | | |
|---|---|---|---|
| 5,614,930 | 3/1997 | Osborne et al. | 347/33 |
| 5,617,125 | 4/1997 | Chew | 347/36 |
| 5,680,162 | 10/1997 | Taylor et al. | 347/35 |
| 5,712,668 | 1/1998 | Osborne et al. | 347/32 |
| 5,714,991 | 2/1998 | Osborne et al. | 347/30 |
| 5,742,303 | 4/1998 | Taylor et al. | 347/36 |
| 5,774,139 | 6/1998 | Salzer et al. | 347/32 |

FOREIGN PATENT DOCUMENTS

| | | | |
|---|---|---|---|
| 407314703A | 12/1995 | Japan | B41J 2/165 |

*Primary Examiner*—N. Le
*Assistant Examiner*—Shih-Wen Hsieh
*Attorney, Agent, or Firm*—Flory L. Martin

[57] ABSTRACT

A translational inkjet printhead servicing station for an inkjet printing mechanism, particularly one having imaging printheads for creating photographic quality images, includes a collapsible spittoon having a mouth that collapses during a portion of the servicing routine to save space. Spit ledges extend into the spittoon mouth to capture ink droplets and ink aerosol by-products, with the captured ink draining from the ledges into a catch basin below. The service station includes a printhead wiper blade having a tip that removes ink residue from the printhead. A dual-direction wiper cleaning system removes liquid components of the ink residue from the wiping tip in two opposing directions. In one direction, the liquid ink residue is pulled away from the wiper tip under capillary forces created by a series of grooves formed on the surface of the wiper blade, while in the opposite direction, the liquid components are absorbed off the tip by a wiper scraper. When the spittoon is collapsed, the wiper resides within a region previously occupied by the spittoon when open.

29 Claims, 7 Drawing Sheets

TRANSLATIONAL SERVICE STATION FOR IMAGING INKJET PRINTHEADS

FIELD OF THE INVENTION

The present invention relates generally to inkjet printing mechanisms, and more particularly to a translational printhead servicing station and method for maintaining inkjet printhead health.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper that wipes the printhead surface to remove ink residue, as well as any media dust or other debris that has collected on the printhead.

Servicing pens has proved quite challenging, with one suitable service station design being a rotary device first sold in the Hewlett-Packard Company's DeskJet® 850C color inkjet printer, and later in the DeskJet® 820C and 870C color inkjet printers. This rotary device mounted the wipers, primers and caps on a motor-operated tumbler. A wiper scrapper and a primer blotter were pivoted to the service station frame and rotated into contact with their associated tumbler appliances by a camming mechanism. The wiper scraper had a series of ink wicking channels which drew liquid ink residue away from the scraper tip and toward the absorbent primer blotter pad. These pens were wiped using an orthogonal wiping technique, where the wipers ran along the length of the linear nozzle arrays, wicking ink along the arrays from one nozzle to the next to serve as a solvent to break down ink residue accumulated on the nozzle plate. This rotary service station used a dual wiper blade system, with special contours on each wiper blade tip to facilitate this wicking action and subsequent cleaning of the orifice plate.

A variety of different spittoon designs have been used in the past, including single-pen and multi-pen designs, large shallow designs, and tall narrow designs having a chimney through which ink was spit for collection below the other service station components. All of these earlier designs used a fixed rigid geometry for the spittoon, which adversely impacted the overall size of the printing mechanism because most spittoons were located between the printzone and the other servicing components, increasing the overall printer width, resulting in additional cost being added to the printer, in both material and shipping costs. Moreover, this greater printer width increased the overall printer size, yielding a larger "footprint," that is, a larger working space was required to receive the printing mechanism, which was undesirable to many consumers.

Early inkjet printers used a single monochromatic pen, typically carrying black ink. Later generations of inkjet printing mechanisms used a black pen which was interchangeable with a tri-color pen, typically one carrying the colors of cyan, magenta and yellow within a single cartridge. The tri-color pen was capable of printing a "process" or "composite" black image, by depositing a drop of cyan, a drop of magenta and a drop of yellow all at the same location. Unfortunately, images printed with the composite black usually had rough edges, and the overall image, even the color portions, often had a non-black hue or cast, depending for instance, upon the type of paper used.

The next generation of printers further enhanced the images by using a dual or quad pen system. The dual pen printers provided a black pen along with a tri-color pen carrying cyan, magenta and yellow ink, with both pens being mounted in a single carriage. The quad pen printers carried four cartridges in a single carriage, while the quad pen plotters used four separate cartridges, with the four pens each carrying one color, black, cyan, magenta or yellow. These dual and quad pen devices printed crisp, clear black text while also providing full color images. Unfortunately, both the dual and quad pen printing systems produced images, such as photographic images, which had a "grainy" appearance. Inkjet printing mechanisms are known as "binary drop devices" because they form images by either placing a drop of ink on the print medium or by not firing. Not firing a droplet leaves either the print medium, or a previously printed drop(s), exposed to view. Unfortunately, such binary drop devices give inherently grainy images due to the visual "step" between the "drop on" and "drop off" regions. For example, when printing a light colored portion of an image, such as a flesh tone, yellow dots were printed and lightly interspersed with magenta dots. When viewed at a distance, these magenta dots provided a flesh tone appearance; however, upon closer inspection the magenta dots were quite visible, giving the image an undesirable grainy appearance. This grainy appearance was similar to the graininess seen in newspaper photographs, or in photos taken using the wrong speed ("ASA" or "ISO" rating) of photographic film in low light conditions.

To provide consumers with near photographic image quality, as well as crisp black text and line art, an imaging inkjet cartridge system was developed for an inkjet printing mechanism, such as the model 693 DeskJet® inkjet printer sold by the Hewlett-Packard Company of Palo Alto, Calif., the present assignee. Here, a multi-pen carriage held either a tri-chamber full color (e.g. cyan, magenta and yellow) cartridge and a monochrome (e.g. black) cartridge, or the monochrome cartridge was replaced with an imaging inkjet cartridge. While the full color cartridge carried full colorant concentrations of inks, the imaging cartridge carried ink formulations having reduced colorant concentrations, such as cyan and magenta, with either a full or a reduced colorant concentration of black ink. Of course, these new cartridges brought new challenges to meet their servicing needs.

SUMMARY OF THE INVENTION

According to one aspect of the present invention, a cleaning system is provided for removing ink residue from a wiper after wiping an inkjet printhead in an inkjet printing mechanism having a chassis. The cleaning system includes a service station supported by the printing mechanism chassis and a wiper scraper of an absorbent material which is also supported by the printing mechanism chassis. The cleaning system also has a wiper supported by the service station to selectively contact and wipe the printhead to remove any ink residue from the printhead, and to selectively contact the wiper scraper to remove any ink residue from the wiper. The wiper has a blade with two opposing side surfaces and a wiping tip. The wiper tip contacts the printhead during wiping and the wiper scraper during wiper cleaning. At least one of the two opposing side surfaces of the blade has a capillary pathway formed on the surface to draw liquid ink residue away from the wiping tip through capillary action.

According to another aspect of the present invention, a method of servicing an inkjet printhead in an inkjet printing mechanism is provided. The method includes the step of providing a first appliance to perform a first servicing step on the printhead, and a second appliance to perform a second servicing step on the printhead. In a collapsing step, the first appliance in collapsed. In a moving step, at least a portion of the second appliance is moved into a region previously occupied by the first appliance prior to starting the collapsing step.

According to a further aspect of the present invention, a service station is provided for servicing an inkjet printhead in an inkjet printing mechanism. The service station includes a service station frame defining a spittoon catch basin, and a first appliance supported by the service station frame to perform a first servicing operation. The service station also has a spittoon comprising the spittoon catch basin and a structure defining a mouth. The mouth is openable to occupy a first region to receive ink ejected from the printhead during a second servicing operation comprising spitting. This structure has a collapsible wall that is moveable to selectively close the spittoon mouth, with the first appliance being positionable into the first region when the spittoon mouth is closed.

According to still another aspect of the present invention, a spittoon is provided for receiving ink spit ejected from an inkjet printhead in an inkjet printing mechanism. The spittoon includes a spittoon catch basin and a structure defining a mouth to receive ink ejected from the printhead during a servicing operation comprising spitting. The spittoon also has a spit ledge that projects into the mouth. The spit ledge is contoured to expel ink received during spitting into the catch basin.

According to another aspect of the present invention, a method of servicing an inkjet printhead in an inkjet printing mechanism is provided. The method includes the step of moving the printhead into a spitting position adjacent a spittoon mouth. Thereafter, in an ejecting step, ink is ejected from the printhead through the spittoon mouth and onto a spit ledge. In a draining step, the ejected ink is drained from the spit ledge into a catch basin.

According to a further aspect of the present invention, an inkjet printing mechanism is provided with a spittoon and a cleaning system, which may be as described above.

An overall goal of the present invention is to provide a printhead service station for an inkjet printing mechanism that facilitates printing of crisp black text and line art, bold color graphics and realistic images of near continuous-tone photographic quality, using a binary ink droplet technology.

Another goal of the present invention is to provide a printhead service station that efficiently uses the servicing space to provide a low-profile, compact inkjet printing mechanism.

A further goal of the present invention is to provide a method of servicing an inkjet printhead that is expediently accomplished in a quiet and efficient manner.

BRIEF DESCRIPTION OF THE DRAWINGS

FIGS. 3–5 are side elevational views of the service station of FIG. 1, with a primer blotter portion of the service station omitted for simplicity, showing various servicing functions, with:

FIG. 3 showing a spitting position with a spittoon portion of the service station being open;

FIG. 4 showing an enlarged view of a capping position with the spittoon portion of the service station being collapsed; and FIG. 5 showing a priming position.

DETAILED DESCRIPTION OF THE PREFERRED EMBODIMENTS

Figure 1:
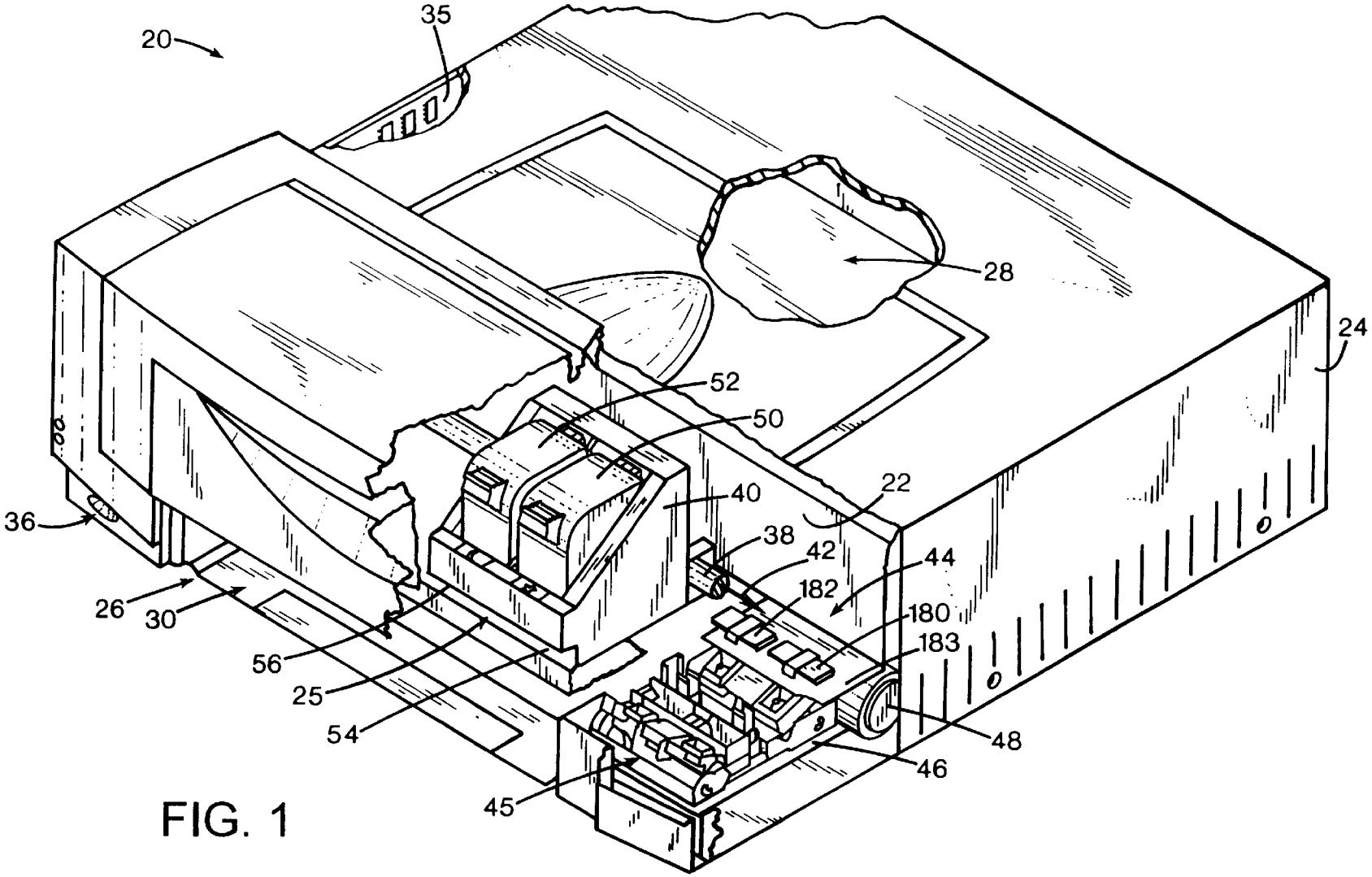
FIG. 1 is a fragmented, partially schematic, perspective view of one form of an inkjet printing mechanism including one form of a translationally moveable inkjet printhead service station of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20 especially designed for printing photographic quality images on plain paper as well as on special treated photographic media, which is typically somewhat thicker and stiffer than conventional plain paper.

While it is apparent that the printer components may vary from model to model, the typical inkjet printer 20 includes a chassis 22 surrounded by a housing or casing enclosure 24, typically of a plastic material. Sheets of print media are fed through a printzone 25 by a media handling system 26, constructed in accordance with the present invention. The print media may be any type of suitable sheet material, such as paper, card-stock, transparencies, mylar, and the like, but for convenience, the illustrated embodiment is described using a photographic quality print medium. The print media handling system 26 has an extractable feed tray 28 that slides into an interior region of the printer for storing sheets of media before printing. A series of conventional motor-driven media drive rollers (not shown) may be used to move the print media from the internal input tray 28 into the printzone 25 for printing. By storing the media supply internally behind the printzone 25, the stiffer photographic quality media may advantageously be fed through the printzone 25 in a relatively flat state, without the need to bend the media 180° around a set of feed rollers as done with many desktop inkjet printers targeted at the business and home markets, such as the Hewlett-Packard Company's DeskJet® 500, 600, and 800 series inkjet printers. After printing, the sheet then lands in an output region 30, which may hold a output tray for receiving the printed media. Advantageously, it is also possible using the media handling system 26 to feed a single sheet of media through the front of the printer 20 for printing, rather than picking media from the input tray 28.

The printer 20 also has a printer controller, illustrated schematically as a microprocessor 35 located inside the casing 24, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. The printer is activated by a user's operation of an on/off push button 36 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth across the printzone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions. For example, a service station frame 46 holds a group of printhead servicing appliances, described in greater detail below, which are selectively moved into servicing positions by a service station motor 48 which operates in response to servicing signals received from the printer controller 35.

In the printzone 25, the media sheet receives ink from two, tri-color imaging inkjet cartridges 50 and 52 in the illustrated embodiment, with the first cartridge 50 dispensing the colors black, light cyan and dark cyan, and the second cartridge 52 containing the colors yellow, light magenta and dark magenta. Here the terms "light" and "dark" refer to the relative concentrations of dye in these inks. Preferably the concentration of the "dark" colors is comparable to that of the earlier, full dye load, tri-color cartridges which contained cyan, magenta and yellow inks, while the dye load concentration of the "light" is less than that of the dark, full color inks. Since the human eye is least visually sensitive to yellow, the concentration of the yellow ink in cartridge 50 is comparable to the of the earlier full dye load tri-color cartridges. Inkjet cartridges, such as cartridges 50 and 52, are often called "pens" by those in the art. For the purposes of illustration, all of these colors, including the black ink held by pen 50 are made of dye based inks. It is apparent that other types of inks may also be used in pens 50, 52, such as thermoplastic inks, pigment-based inks, wax or paraffin based inks, as well as hybrid or composite inks having both dye and pigment characteristics.

The illustrated pens 50, 52 each have printheads 54, 56 respectively, with an orifice plate having a plurality of nozzles formed therethrough in a manner well known to those skilled in the art to dispense the ink. The illustrated printheads 54 and 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 35 to the printhead carriage 40, and through conventional interconnects between the carriage and pens 50, 52 to the printheads 54, 56.

Translational Service Station

Figure 2:
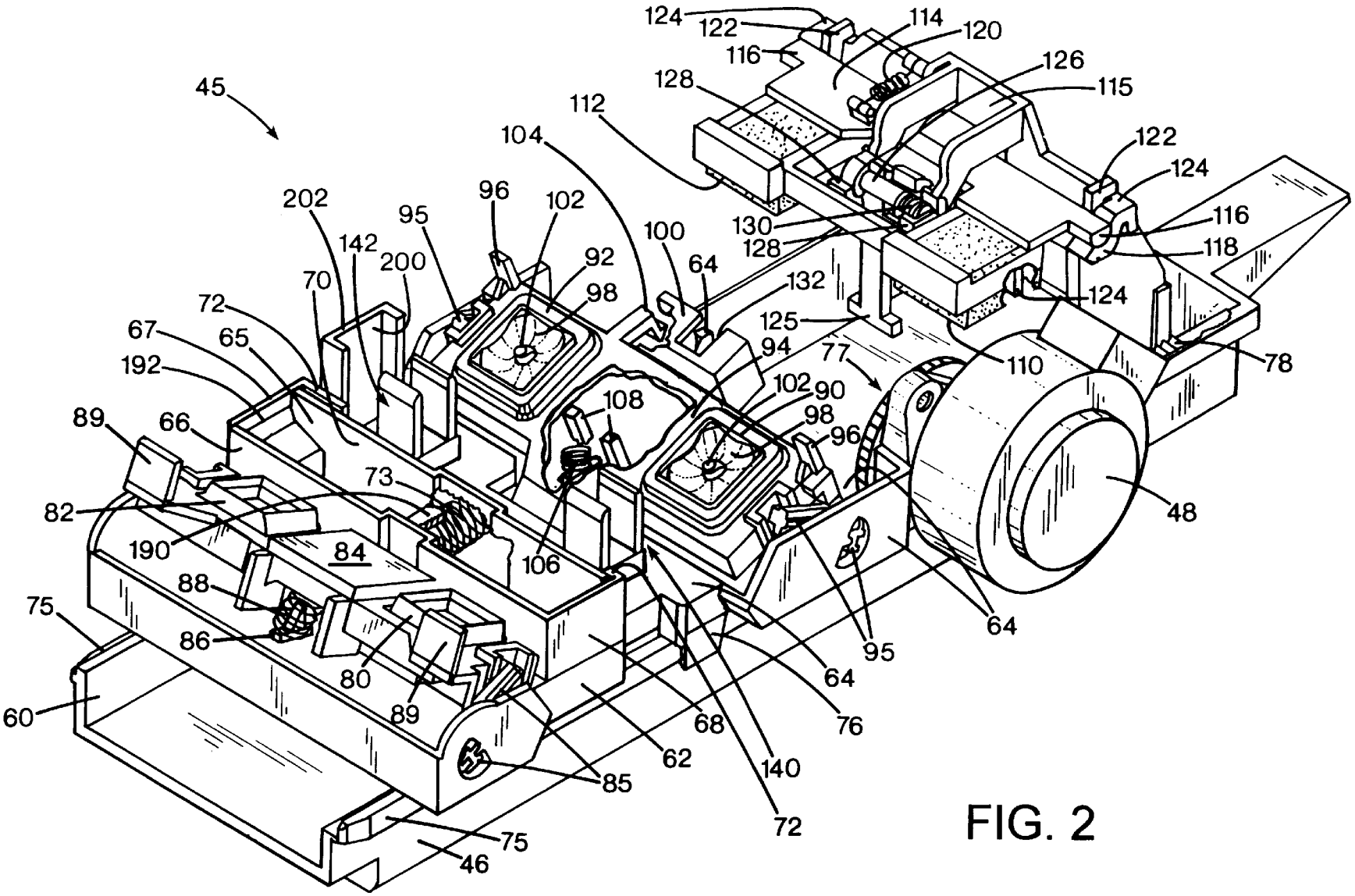
FIG. 2 is an enlarged perspective view of the service station of FIG. 1.

FIG. 2 shows the translational service station 45 constructed in accordance with the present invention as having a frame 46 including a stationary base 60, and two sliding platforms pallets or shuttles, here a cap shuttle 62 and a primer shuttle 64, joined together to define a collapsible spittoon 65. The spittoon 65 has a mouth which is defined by a front wall 66 and bordered by two sidewalls 67 and 68, each of which extend upwardly from the cap shuttle 62. The mouth of spittoon 65 is also defined by a rear wall 70 which extends upwardly from the primer shuttle 64. The sidewalls 67 and 68 each have a rear wall stop 72 which captures the spittoon rear wall 70. The cap and primer shuttles 62, 64 are biased away from one another by a biasing element such as a coil spring 73 which extends through the interior of spittoon 65. The maximum separation of the cap and primer shuttles 62 and 64 is reached when the rear wall 70 contacts the sidewall stops 72.

The frame base 60 has a pair of side rails 75 which extend outwardly from the base and are engaged by a series of gripping fingers 76 which extend downwardly from both the cap and primer shuttles 62, 64. The gripping fingers 76 slideably engage the rails 75 to allow the shuttles 62, 64 to move forward (to the left in FIG. 2) and backward (to the right in FIG. 2) along the length of the service station base 60. The translating shuttles 62, 64, may be driven linearly using a variety of different propulsion devices. In the illustrated embodiment, the service station motor 48 is mounted to the primer shuttle 64 to travel with the shuttles 62, 64 as they move to various servicing locations along the frame base 60. The drive assembly includes a reduction gear assembly 77 which is also mounted to the primer shuttle 64. The reduction gear assembly 77 includes a pinion gear (not shown) that rides on the motor output shaft and drives a larger transfer gear seen in FIG. 2 behind motor 48. A smaller output drive gear is mounted on the same shaft as the large transfer gear and engages a rack gear 78 which may be integrally molded into the frame base 60.

Figure 3:
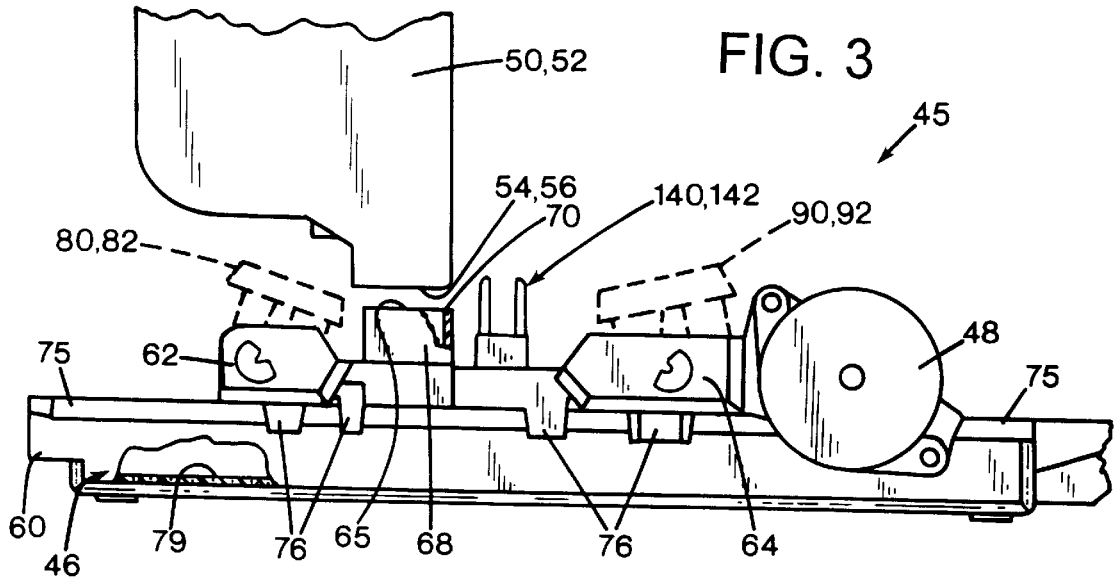

FIG. 3 shows the service station 45 in a spitting position. Here, the motor 48 has moved the cap and primer shuttles 62, 64 to position the spittoon 65 directly under the printheads 54, 56 when in the servicing region 44. The interior of the service station base 60 defines a spittoon catch basin which may optionally be lined with an absorbent member, such as a spit pad 79. The spit pad 79 may be of any type of liquid absorbent material, such as of a felt, pressboard, sponge or other equivalent material.

Returning to FIG. 2, the cap shuttle 62 serves as a mounting location for first and second printhead caps 80, 82 which respectively seal printheads 54, 56 of the pens 50, 52. The pair of caps 80 and 82 may be constructed from any conventional material known to those skilled in the art, but preferably, they are of a resilient, non-abrasive, elastomeric material, such as nitrile rubber, or more preferably, ethylene polypropylene diene monomer (EPDM). The caps 80, 82 may be constructed in a conventional manner, such as by onsert molding the caps onto a cap sled 84. The cap sled 84 is pivoted to the cap shuttle 62 using a U-shaped link or yoke member 85. A rocker member 86 grips a central portion of the sled 84, and a biasing member, such as a coil spring 88 surrounds the rocker member 86 to bias the cap sled 84 into a lowered rest position, shown in FIGS. 2, 3 and 5. The cap sled 84 also has a pair of upwardly extending engaging arms 89 that engage the carriage 40. The construction and operation of the illustrated capping assembly, including items 80 through 89, is of substantially the same function as the rotary capping system commercially available on the DeskJet® 850C, 855C, 820 and 820C color inkjet printers sold by the Hewlett-Packard Company. The shape of the U-shaped link 85 has been varied slightly to adapt the earlier rotary printhead engagement platform to the illustrated translational platform.

Figure 4:
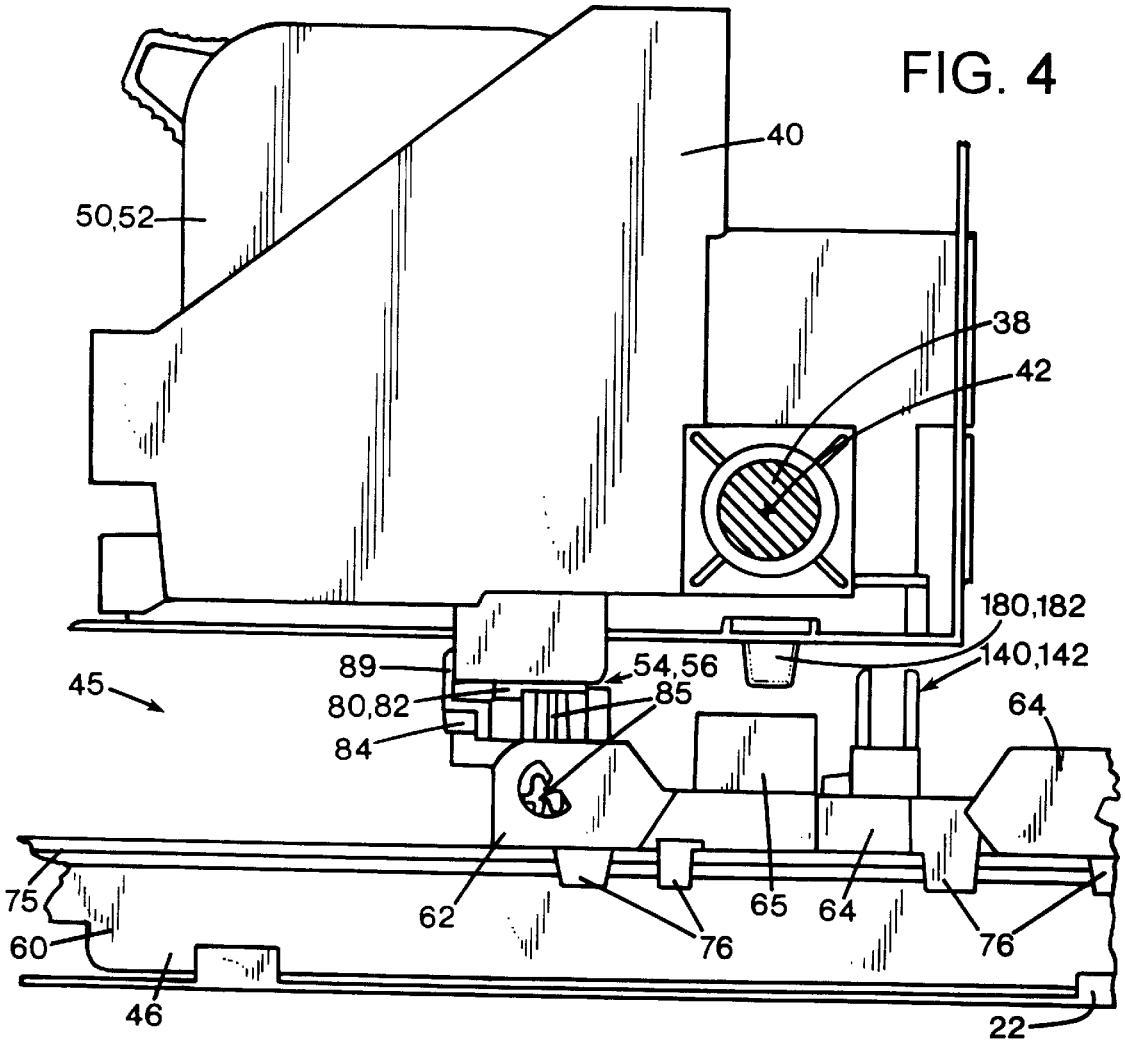

FIG. 4 illustrates the capping operation where the printheads 54, 56 are sealed by the caps 80, 82. The motor 48 has moved the shuttles 62, 64 rearwardly to a capping position. During this move to the capping position, the cap sled arms 89 have been pulled against the snout portion of the printheads 54, 56, or preferably, against a portion of the carriage 40, causing the cap sled 84 to be lifted into the capping position. To avoid depriming the printheads by forcing air into the nozzles, the printhead caps 80, 82 include a vent path (not shown) to atmosphere. This vent path may be defined by a groove formed along an undersurface of the cap sled 84. The vent path for each cap may also be defined in part by a soft rubber vent plug (not shown) wedged in recesses defined by the undersurface of the cap sled 84 beneath each of the caps 80, 82. This venting system may be constructed in a manner similar to that used in venting the rotary capping system available on the DeskJet® models 850C, 855C, 820C and 870C inkjet printers.

Figure 5:
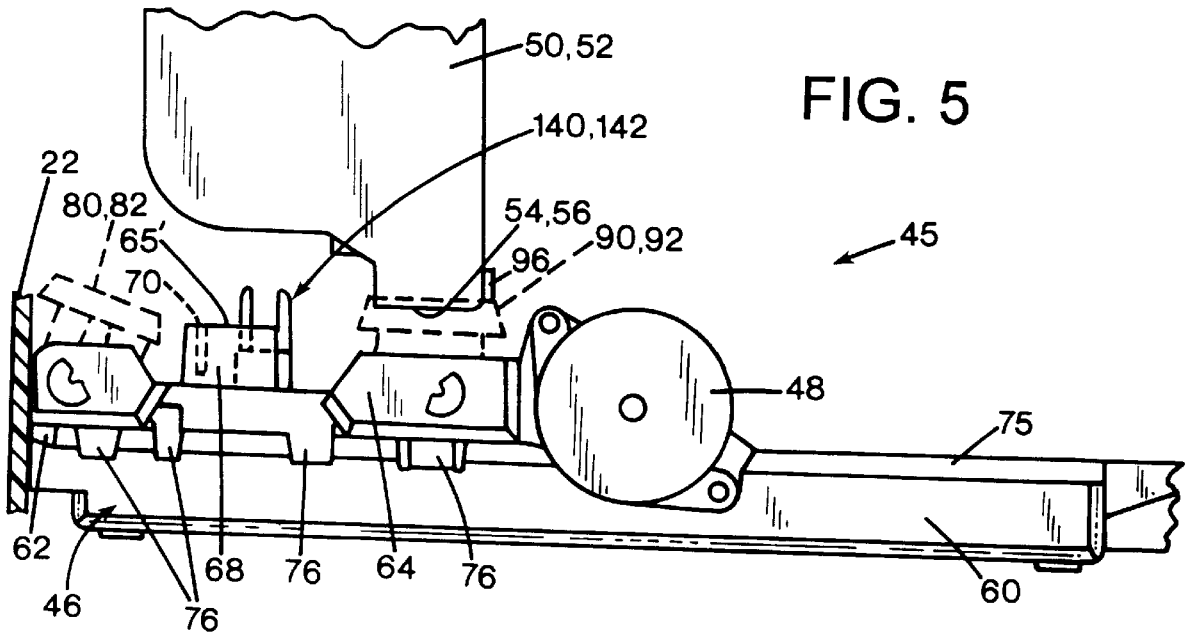

The primer shuttle 64 supports a pair of printhead primers 90, 92 which selectively engage and prime the printheads 54, 56 of pens 50, 52, respectively, as shown in FIG. 5. Returning to FIG. 2, the primers 90, 92 are shown supported by a primer sled 94. The sled 94 may be pivotally mounted to the primer shuttle 64 by a U-shaped link or yoke member 95, which may be of the same construction as the cap yoke 85. A spring biased rocker member (not shown) may also be used to bias the primer sled 94 in a rest state, as shown in FIGS. 2 and 5, in the same manner in which the rocker 86 and spring 88 bias the cap sled 84. The primer sled 94 also has printhead engaging fingers 96 which extend upwardly to engage a snout portion of the printhead to raise the primer sled 94 into a priming position, shown in FIG. 5.

Each of the primers 90, 92 has a rolling diaphragm primer cap 98 which is coupled to a triggering mechanism 100 by a gripping finger 102 that extends upwardly through a hole formed in the center of the diaphragm 98. The components of the primer assembly, including the primers 90, 92 their manner of attachment to the sled 94 and trigger mechanism 100, as well as the mounting of the sled 94 to the primer shuttle 64, are of substantially the same construction and operation as the rotary priming system sold in the DeskJet® 850C, 855C, 820C and 870C color inkjet printers, manufactured by the Hewlett-Packard Company, with minor modifications being made to adapt to the rotary priming platform into the translational platform illustrated in FIG. 2.

Briefly, the trigger mechanism 100 is biased upwardly into a latched, ready-to-prime state through engagement with a trigger 104 extending from the rear edge of the primer sled 94, as shown in FIG. 2. In this ready-to-prime state, the gripping fingers 102 extend upwardly to buckle the diaphragm caps 98, which reduces the volume inside the diaphragms 98. As the motor 48 moves the primer shuttle 64 forward, the sled arms 96 engage the snout portions of printheads 54, 56 to begin raising the primer sled 94 to the priming position of FIG. 5. Continued forward motion of shuttle 64 raises the sled 94 and eventually pushes the trigger 104 into an upright finger member 105 that extends upwardly from the primer shuttle 64. When the trigger 104 is released by contacting the finger 105, a biasing spring 106 located under the primer sled 94 pushes the trigger mechanism 100 downwardly. The downward motion of the trigger mechanism 100 draws the gripping fingers 102 downward which expands the internal volume defined by the rolling diaphragms 98. This sudden increase in volume creates a vacuum which pulls any ink clogs or other obstructions from the nozzles of the printheads 54, 56. Preferably, the trigger mechanism 100 also includes a pair of standoff fingers 108 which extend upwardly through holes defined by the primer sled 94. The standoff fingers 108 prevent the rolling diaphragms 98 from making a complete sealing contact with the printheads 54, 56 until after the trigger mechanism has been activated and the vacuum pulling process has begun. Thus, the standoff fingers 108 prevent a premature contact of the diaphragms 98 with the printhead, which could otherwise force air into the nozzles and deprime them.

The service station 45 also includes a primer blotting mechanism which includes first and second primer blotters 110, 112 which may be of an absorbent material, such as a polyolefin material, for instance a polyurethane or polyethylene sintered plastic, which is a porous material, and more preferably that manufactured by the Porex Company of Atlanta, Ga. The primer blotters 110. 112 are secured within a blotter frame 114 which is pivotally attached to a support member 115 extending upwardly from the frame base 60. The blotter frame 114 has two outwardly projecting axles 116 which pivot within bearings 118 of the frame 115, with a biasing element, such as spring 120, holding the blotter frame 114 in an elevated rest position, as shown in FIG. 2. Further upward rotation of the blotter frame 114 is prevented by a pair of frame stops 122 extending from frame 114 to engage a stop surface 124 of the support 115.

Rearward motion of the primer shuttle 64 eventually brings the rear edge of the primer sled 94 into contact with a blotter activation arm 124 which extends downwardly from the blotter frame 114. As the primer shuttle 64 travels rearwardly and engages the activation arm 124, the blotter frame 114 pivots at axles 116 downwardly until the blotters 110, 112 contact the rolling diaphragms 98 of the primers 90, 92, respectively. The blotters 110, 112 absorb any ink residue remaining within the rolling diaphragms 98 after the priming operation.

The blotter support 115 also serves as a pivotal mounting point for a T-bar shaped trigger resetting mechanism 125. The upper portion of the trigger reset 125 terminates in an axle portion 126 which is pivotally received within bearings 128 defined by the support 115. Preferably a biasing member, such as a coil spring 130 surrounding the axle 126, pushed the T-bar 125 downwardly into a rest position as shown in FIG. 2. As the primer sled 64 moves rearwardly into the blotting position, the lower end of the T-bar trigger reset 125 is captured within a U-shaped recess 132 defined by a portion of the trigger 100. Once the T-bar reset 125 is captured within recess 132, further rearward motion of the primer shuttle 64 causes the T-bar 125 to pull the trigger mechanism 100 upwardly, into a triggered state which is then secured by engagement of the trigger finger 104 with the trigger 100. Following blotting, forward motion of the primer shuttle 64 pulls the trigger 100 away from the T-bar reset 125, leaving the trigger mechanism 100 ready for the next priming operation.

Figure 6:
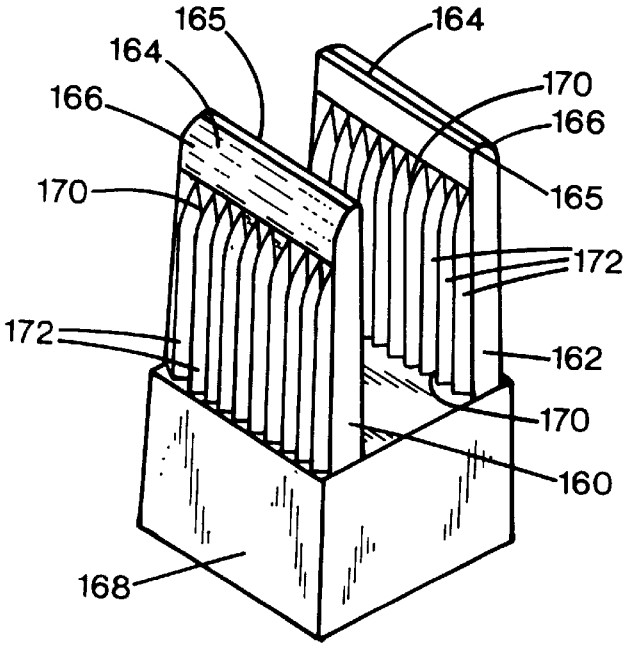
FIG. 6 is an enlarged perspective view of the wipers of FIG. 1.
Figure 8:
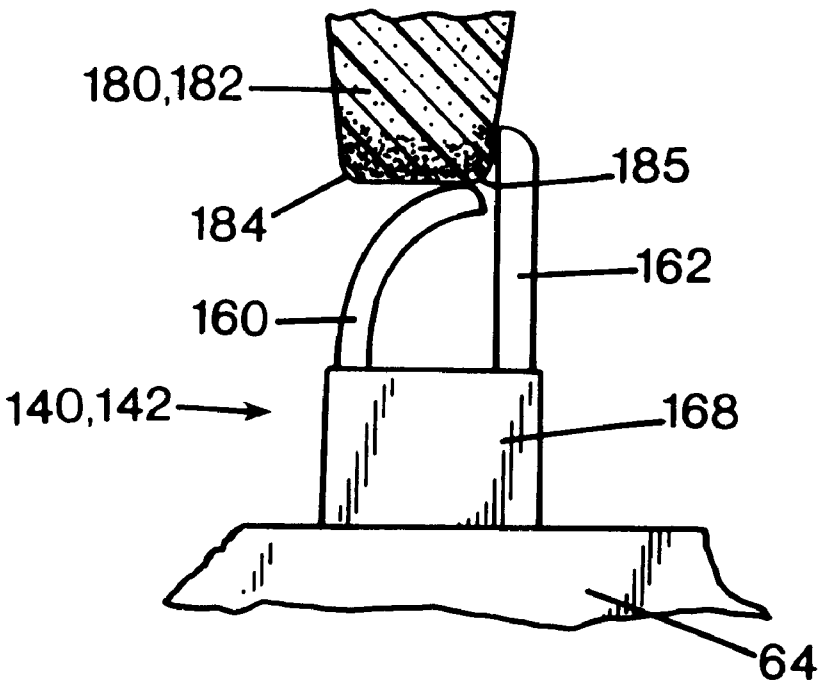
FIG. 8 is an enlarged side elevational view of the wipers of FIG. 1 shown during wiper scraping which cleans ink residue from the wipers.
Figure 7:
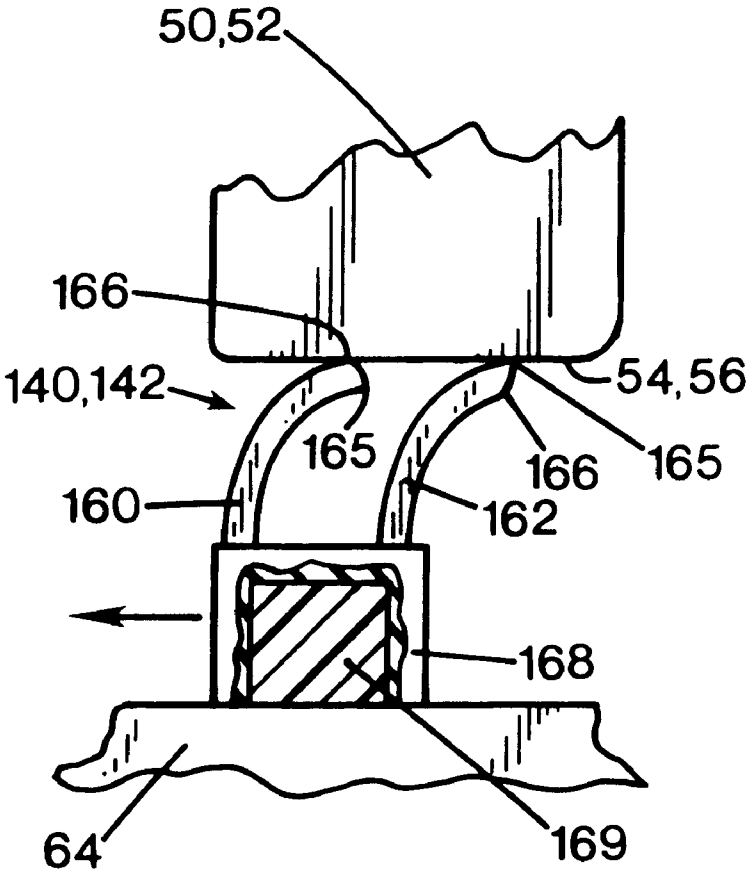
FIG. 7 is an enlarged side elevational view of the wipers of FIG. 1 shown during printhead wiping.

Also mounted on the primer sled 64 are first and second wiper assemblies 140 and 142 which wipe and clean printheads 54, 56 of pens 50, 52, respectively. A preferred embodiment for the construction of wipers 140, 142 is illustrated in FIGS. 6–8. Each of the wipers 140, 142 includes a pair of wiper blades, 160, 162 which each have a wiping tip 164 with an inboard angular wiping edge 165 and a outboard rounded edge 166. While the angular wiping edge 165 may be either an acute or an obtuse angle, preferably the edge 165 is about 90°. During a wiping stroke shown in FIG. 7, the outboard rounded edge 166 of the leading blade first contacts the orifice plate, followed by the angular inboard wiping edge 165 of the trailing blade. The rounded edge 166 of the leading blade 160 aids in wicking ink from the nozzles of the printheads 54, 56 using the capillary force generated by the small space between the printhead and the rounded wiping edge 166. The rounded edge 166 then drags the extracted ink toward the next nozzle in the orifice plate array where the wicked ink acts as a solvent to dissolve any ink residue or other debris surrounding the next nozzle or nozzles. The angular wiping edge 165 of the trailing blade 162 then cleans the dissolved ink residue and ink from the orifice plate. This dual wiper blade system leaves the printheads 54, 56 clean of debris and residue so during printing the ink droplets may be ejected along a true trajectory from the nozzles to form a clear, crisp image on the media.

Preferably the wiper blades 160, 162 are integrally molded with a hollow base 168. The base 168 of each wiper 140, 142 resiliently grips one of two upright support posts 169 projecting upwardly from the primer shuttle 64. It is apparent that the blades 160, 162 may be mounted to the shuttle 64 in a variety of different ways known to those skilled in the art, such as by using onsert molding techniques.

FIG. 6 shows the preferred embodiment of the wiper blades 160, 162 as each having inboard and outboard surface lined with a series of lands and recesses, such as grooves and ridges 170 and 172. Each groove 170 forms a narrow passageway that advantageously wicks liquid ink and ink components through capillary action downwardly and away from the cleaning tips 164 of the wiper blades 160, 162. The force of gravity also assists in drawing the liquid ink residue away from the wiping tips 164.

To remove any ink residue remaining on the blade tips 164 of wipers 140 and 142, a pair of wiper scrapers 180, 182 are mounted to an overhanging support portion 183 of the printer chassis 22, as shown in FIG. 1. The wiper scrapers 180, 182 are of a porous material, which may be the same material as used for the primer blotters. Earlier service stations designs have proposed mounting a wiper scraper to the service station frame, either as a rigid plastic member, or as an elastomeric member. The use of a porous material for the wiper scrapers 180, 182 absorbs any liquid ink residue from the blade tips 164, and the entrances to the grooves 170. Preferably the scrapers 180 and 182 each have rounded edges 184, 185 that assist in removing other debris, such as paper or media fibers, dust and lint, from the surfaces of the blades 160, 160.

By placing the grooves and ridges 170, 172 along the interior and exterior walls of the wiper blades 160, 162, it is believed that any excess liquid ink is readily removed from the wiping tips 164. This is particularly advantageous when performing a rapid wiping sequence, where following several wiping strokes the blades 160, 162 are moved to the wiper scrapers 180, 182 for removal of ink residue. Such a multiple stroke wiping sequence with occasional wiper cleaning by contact with the scrapers 180, 182 provides faster servicing of the printheads 54, 56 so the printheads may return quickly to printing. Moreover, while other servicing mechanisms, such as that disclosed in U.S. Pat. No. 5,555,461, advocate the use of grooved wiper blades in conjunction with an absorbent material located near the base of the wipers, such a system is believed to allow ink residue to accumulate and coagulate in the grooves, and moreover, to flake off during subsequent wiping operations and dirty the servicing area.

Thus, the grooves 170 pull ink in one direction, here downwardly, from the wiping edges 165, 166, whereas the wiper scrapers 180, 182 remove ink residue in the opposite direction, here upwardly away, away from the wiping edges 165, 166. Such a dual-direction, active ink removal method for cleaning a printhead wiper is believed to be a unique concept. Thus, the combination of the grooved wiper blades 160, 162 with the wiper scrapers 180, 182 for dual-direction wiper cleaning is believed to provide for more expedient servicing, as well as maintenance of a cleaner servicing region 44.

Figure 9:
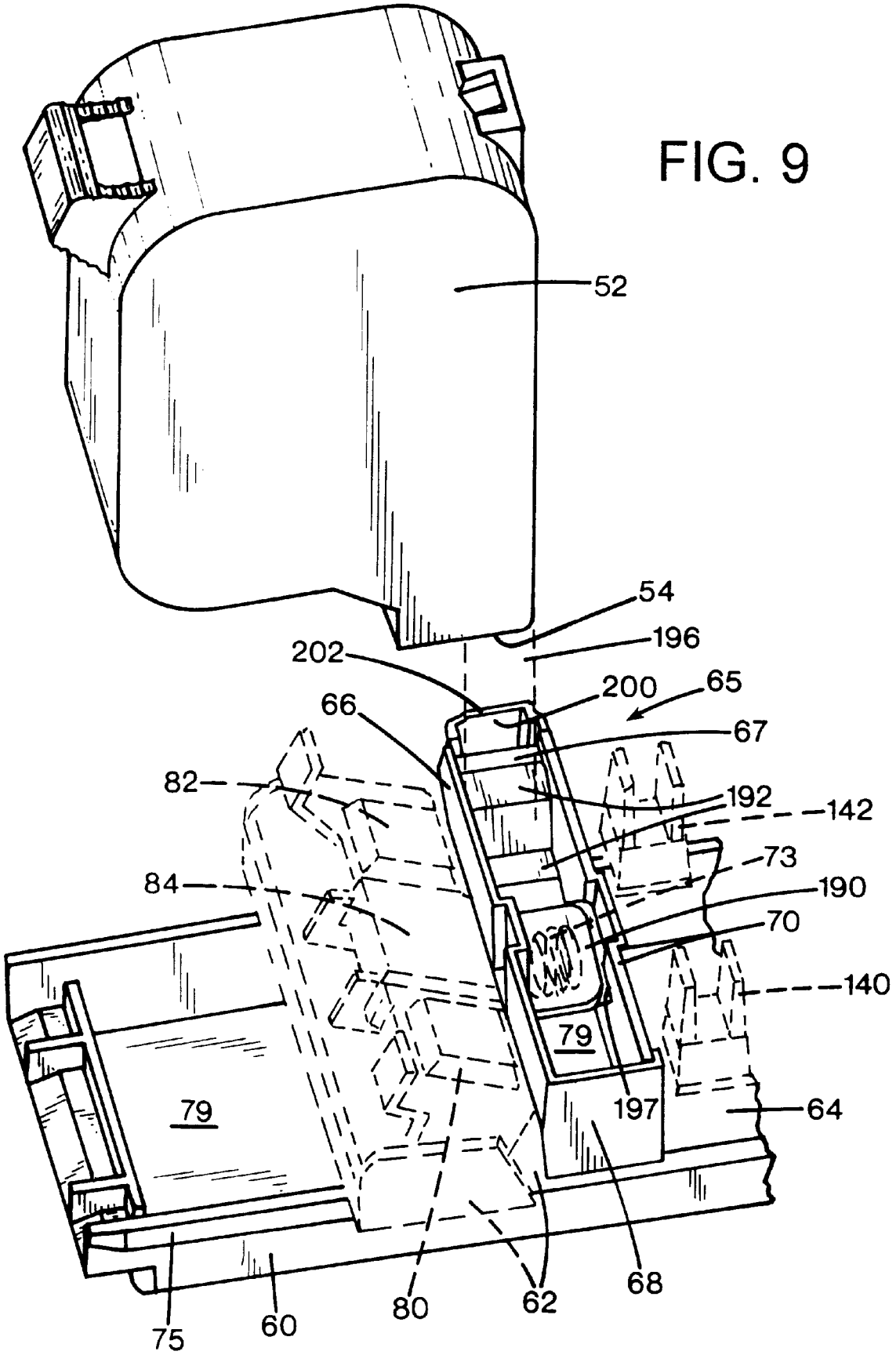
FIG. 9 is a perspective view of one inkjet cartridge spitting into the spittoon portion of FIG. 1.
Figure 10:
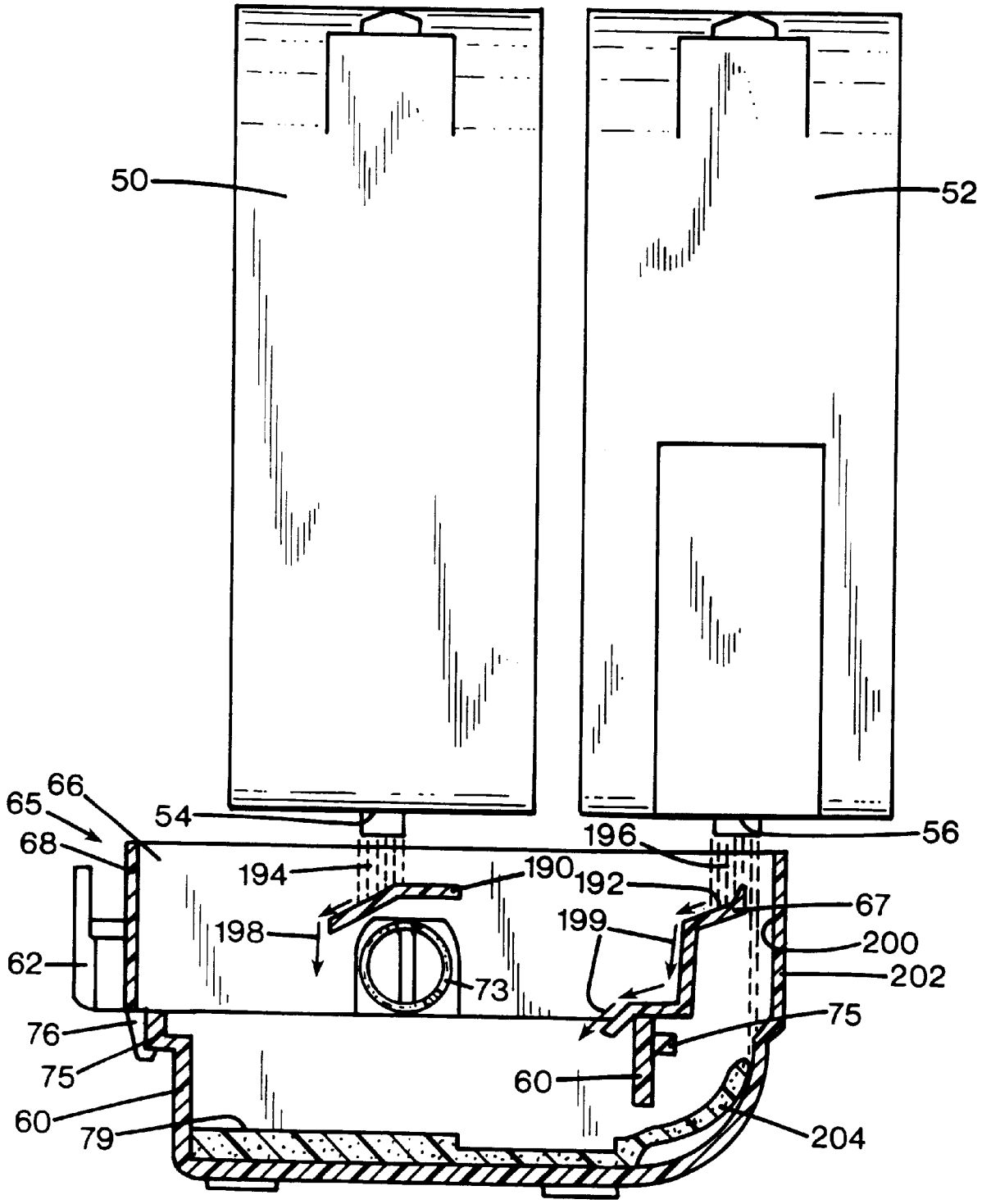
FIG. 10 is a rear elevational cross-sectional view of both inkjet cartridges, with the carriage omitted for clarity, located in an alternate rapid spitting position over the spittoon portion of FIG. 1.

FIGS. 9 and 10 illustrate a rapid spitting position of the printheads 54, 56, where the printheads are preferably spit before each printing swath trip across the printzone 25. In this rapid spitting position of FIGS. 9 and 10, the pens 50, 52 are only brought partially into the servicing region 44, whereas for a full pre-cap spitting routine the printheads 54, 56 are fully lodged within the servicing region and in-line with the other servicing appliances, i.e. caps 80, 82, primers 90, 92, and wipers 140, 142. The fully lodged servicing position allows priming, uncapping/capping, wiping and spitting to all be performed without moving the printhead carriage 40, which speeds servicing and avoids generating carriage noise, so the servicing is performed quickly and quietly.

In the fully lodged servicing position, the carriage 40 travels along a carriage adjust ramp (not shown), which may be provided to move the carriage up or down from a printing level used to traverse the printzone 25, to a servicing level used to cap, prime and wipe the printheads 54, 56. This carriage adjust ramp advantageously decouples the need to adjust both the printing level and servicing level to the same plane, as was required in many earlier printers; however, some noise is generated as the carriage moves along this ramp into the fully lodged position. As mentioned above, preferably, the pens 50, 52 perform a spitting cycle between each print swath. To avoid the ramp travel noise, as well as the additional time required to traverse the ramp, the rapid spitting position of FIGS. 9 and 10 was conceived.

A problem recently encountered with inkjet printing is the generation of inkjet aerosol, a by-product of the ink ejection process. This ink aerosol comprises ink satellites, which are about 0.1–5.0 micron-sized airborne ink particles that are generated while the printheads 54, 56 eject ink droplets of a desired size for printing or spitting. Ink droplets larger than 5.0 microns usually impact in the desired location, either on the print media, or in the service station spittoon, rather than becoming airborne satellites. If left unchecked, the small size and mass of these aerosol particles allows them to float in the air, migrating to settle in a variety of undesirable locations, including surfaces inside the printer 20. Motion of the printhead carriage 40 generates air currents that may carry the ink aerosol onto critical components, such as the carriage position encoder optics, the encoder strip, or the printed circuit boards. Aerosol fogging of the optical encoder components may cause opacity, as well as light scattering or refraction, resulting in the loss of carriage position or velocity information. This migrating ink aerosol may also increase friction and cause corrosion of moving components, as well as degrading the life of critical components. For example, ink aerosol may accumulate along the printhead carriage guide rod 38, decreasing carriage bushing life and increasing friction during normal operation. On the printed circuit boards of controller 35, the ink aerosol may cause corrosion or electrical shorts. In addition, this aerosol may settle on work surfaces near the printer, where it can then be transferred to an operator's fingers, clothing or other nearby objects. One earlier method for controlling aerosol used shallow spittoons which had surfaces close to the printhead, to capture the floating aerosol, but unfortunately, these shallow spittoons filled quickly with ink and clogged.

The fully lodged position is preferred for pre-page, end-of-page, and pre-cap spitting, where no carriage movement follows spitting, so any aerosol generated during the pre-cap spit is not pulled out of the servicing region 44 by the carriage 40. For the rapid spitting position, which is followed by carriage motion toward the printzone 25, a method of rapidly trapping the aerosol was needed. It was discovered that the aerosol satellites traveled in the general direction of the main ink droplet for a distance of about 10–15 mm (millimeters) from the printheads 54, 56 before beginning to float randomly, being pulled along by air currents within the printer, such as those generated as the carriage 40 left the servicing region 44. The challenge then became finding a way to capture the aerosol before it began to float randomly, without encountering the drawbacks of the earlier shallow spittoon designs.

To address the aerosol problem during the rapid spitting sequence between print swaths, the spittoon 65 includes two spit platforms or ledges 190, 192 for receiving ink spit 194, 196 from pens 50, 52, respectively. In FIGS. 9 and 10, the ink spit 194, 196 from printheads 54, 56 is shown in dashed lines, and schematically includes both the main ink droplets and the aerosol by-product. The spit ledges 190 and 192 project rearwardly from the front wall 66 into the interior of the spittoon 65, with the rear wall 70 defining a slot 197 through which ledge 190 passes over the spring 73 to reach the collapsed position of FIG. 5. The inboard edge of wall 70, toward the printzone 25, is contoured to ride over the ramps of ledge 192, as best shown in FIG, 2, to reach the FIG. 5 collapsed position. Preferably, the spit ledges are located about 10 mm below the printing level of printheads 54, 56, as shown in FIG. 10. Ink spit 194, 196 hitting the ledges 190, 192, including the main droplets and aerosol, drains under the force of gravity along the downwardly sloping ledges, as indicated by arrows 198, 199, respectively. The ink spit 194, 196 is expelled from the ledges by dripping onto the spit pad 79 that lines the interior of the catch basin defined by the service station frame 60. During the fully lodged spitting sequences, with the printheads 54, 56 aligned with the other servicing appliances, such as the wipers 140, 142, the ink spit 194, 196 misses the spit ledges 190, 192 and goes directly through the spittoon mouth onto the spit pad liner 79.

In the particular design of imaging printer 20 illustrated, rapid spit position of FIG. 10 is dictated by the beginning of the carriage adjust ramp, described above, which moves the carriage between printing and servicing elevations. The overall width of the service station 45 could have been increased so the spit ledge 192 defined by wall 67 captured all of the ink spit 196 from pen 52, but this would have increased the overall printer width, increasing the footprint of the printer 20. Instead, the overall printer width is advantageously decreased by adding an auxiliary spittoon chimney 200. The auxiliary spittoon 200 is defined by a U-shaped channel wall 202, extending upwardly from the service station base 60, and the surface the inboard sidewall 67 which faces toward the printzone 25. The base of the auxiliary spittoon 200 may be lined with a cut-out portion 204 of the spit pad liner 79. The liner cut-out 204 aids in wicking the portion of the ink spit 196 falling into the auxiliary spittoon 200 into the main portion of the spit pad 79 laying in the spittoon catch basin. The remainder of the ink spit 196 from printhead 56 lands on ledge 192, and drips into the catch basin, as indicated by arrow 199 in FIG. 10.

In operation, FIGS. 3, 9 and 10 illustrate spitting portions of a servicing routine, where the service station motor 48 has positioned the spittoon 65 directly beneath printheads 54, 56 for receiving ink spit therefrom. FIG. 4 illustrates the capping operation, where the cap sled arms 89 have been pulled against the front of the snout portion of the printheads 54, 56 to raise the cap sled 84 into a capping position. FIG. 5 shows the priming operation, where the primer sled contact arms 96 have been driven against the rear of the snout portion of the printheads 54, 56 to raise the primer sled 94 into a priming position, for drawing ink clogs and obstructions from the printhead nozzles, as described above. The wiping operation is illustrated in FIG. 7, while the cleaning of the wiper blades 160, 162 using the scrapers 180, 182 is shown in FIG. 8. As the wiper blades 160, 162 leave the scrapers 180, 182 any ink residue remaining on the wiper tips 164 may be flicked off the blade tips as the blades 160, 162 return to their unstressed upright orientation from their bent orientation shown in FIG. 8; however, absorption of ink residue using the wiper scrapers 180, 182 is preferably the primary manner of cleaning the wiper blades 160, 162.

Of particular interest is the priming operation of FIG. 5 where the collapsible spittoon 65 is shown in a collapsed state, with the spittoon mouth being closed, as indicated by the item number 65'. The rear wall 70 of the spittoon has moved forward to contact the front wall 66. In closing the spittoon mouth, the wipers 140, 142 are seen to have moved into the region previously occupied by the spittoon 65. This is a unique space saving feature, where, during a portion of the servicing routine, one printhead appliance has moved into the space or region previously occupied by another printhead appliance. Moreover, the concept of a collapsible spittoon is believed to be new, where the spittoon mouth is open to receive ink, and then becomes closed during subsequent servicing operations.

Thus, the concept of one servicing appliance sharing the space previously occupied by another servicing appliance while both appliances are inactive is believed to be a unique concept, with the collapsed servicing mechanism then returning to a normal state upon further movement of the servicing mechanism to another servicing position. Note that while the primers 90, 92 are shown priming the printheads while the spittoon 65' is collapsed, an equally useful arrangement of the servicing appliances may allow capping while the spittoon 65' is collapsed. Moreover, in other implementations, other appliances, such as the cap sled 84 or the primer sled 94 could be moved into the collapsed spittoon region. This collapsing feature is particularly advantageous in producing a more compact inkjet jet printing mechanism that has a smaller "footprint," occupying less workspace.

We claim:

1. A cleaning system for removing ink residue from a wiper after wiping an inkjet printhead in an inkjet printing mechanism having a chassis, comprising:

a service station supported by the printing mechanism chassis;

a wiper scraper of an absorbent material supported by the printing mechanism chassis;

a wiper supported by the service station to selectively contact and wipe the printhead to remove any ink residue therefrom and to selectively contact the wiper scraper to remove any ink residue from the wiper, wherein the wiper comprises a blade having two opposing side surfaces and a wiping tip, with the wiper tip contacting the printhead during wiping and the wiper scraper during wiper cleaning, and with at least one of the two opposing side surfaces of the blade having a capillary pathway formed thereon to draw liquid ink residue away from the wiping tip through capillary action;

a spittoon comprising a catch basin and a structure defining a mouth above the catch basin, with the mouth openable to occupy a first region to receive ink ejected from the printhead during a first servicing operation comprising spitting, with said structure including a collapsible wall moveable to close the spittoon mouth during a second servicing operation; and first and second moveable platforms;

wherein the wiper is supported by the second moveable platform, and the wiper is positionable into the first region during the second servicing operation;

wherein the spittoon structure includes a first wall section supported by the first moveable platform, with the collapsible wall being supported by the second moveable platform, and with the first and second moveable platforms being separated from each other to open the spittoon mouth and moved toward each other to close the spittoon mouth.

2. A cleaning system according to claim 1 wherein:

the service station includes a moveable platform; and the wiper is supported by the moveable platform.

3. A cleaning system according to claim 2 wherein the moveable platform comprises a translating platform that selectively moves the wiper into contact with the printhead during wiping and into contact with the wiper scraper during wiper cleaning.

4. A cleaning system according to claim 1 wherein both of the two opposing side surfaces of the blade have a capillary pathway formed thereon.

5. A cleaning system according to claim 1, wherein:

during spitting, a main ink droplet and an ink aerosol by-product are ejected from the printhead; and the spittoon further includes a spit ledge projecting from a portion of said structure into the mouth when open, with the spit ledge located between the printhead and the catch basin to receive the main ink droplet and ink aerosol by-product ejected from the printhead during spitting, with the spit ledge contoured to expel ink received during spitting into the catch basin.

6. A method of servicing an inkjet printhead in an inkjet printing mechanism, comprising the steps of:

providing a first appliance to perform a first servicing step on the printhead, and a second appliance to perform a second servicing step on the printhead;

collapsing the first appliance; and moving at least a portion of the second appliance into a region previously occupied by the first appliance prior to starting the collapsing step.

7. A method according to claim 6 wherein:

the first appliance has two portions, and the collapsing step comprises translationally moving said two portions together; and the moving step comprises translationally moving the second appliance.

8. A method according to claim 6 wherein:

the providing step further comprises providing a third appliance to perform a third servicing step on the printhead; and the method further includes the step of, after starting the moving step, performing the third servicing step on the printhead using the third appliance.

9. A method according to claim 8 wherein the third appliance comprises a primer, and the third servicing step comprises priming the printhead with the primer.

10. A method according to claim 6 wherein:

the first appliance comprises a spittoon; and the method further includes the steps of opening the spittoon, and removing the second appliance from said region; and thereafter, performing the first servicing step comprising the steps of aligning the printhead with the open spittoon, and then ejecting ink from the printhead into the spittoon.

11. A method according to claim 6 wherein:

the second appliance comprises a wiper; and the method further includes the step of wiping the printhead with the wiper to perform the second servicing step.

12. A method according to claim 11 further including the steps of:

during the wiping step, accumulating ink residue on the wiper;

pulling a first portion of a liquid component of the ink residue away in a first direction from a wiping tip of the wiper using a capillary force; and absorbing a second portion of the ink residue liquid component from the wiping tip in a second direction opposite from the first direction.

13. A method according to claim 12 wherein the wiper comprises a resilient blade having a base end opposite the wiping tip, and the first direction is toward the base end, with the blade having two opposing side surfaces at least one of which has a capillary pathway formed thereon, and with the pulling step comprising creating the capillary force with the capillary pathway.

14. A service station for servicing an inkjet printhead in an inkjet printing mechanism, comprising:

a service station frame defining a spittoon catch basin;

a first appliance supported by the service station frame to perform a first servicing operation; and a spittoon comprising the spittoon catch basin and a structure defining a mouth openable to occupy a first region to receive ink ejected from the printhead during a second servicing operation comprising spitting, with said structure including a collapsible wall moveable to selectively close the spittoon mouth; and wherein the first appliance is positionable into the first region previously occupied by the spittoon mouth when open.

15. A service station according to claim 14 wherein:

the service station includes first and second moveable platforms;

the first appliance is supported by the second moveable platform; and the spittoon structure includes a first wall section supported by the first moveable platform, with the collapsible wall being supported by the second moveable platform, and with the first and second moveable platforms being separated from each other to open the spittoon mouth and moved toward each other to close the spittoon mouth.

16. A service station according to claim 15 wherein the service station further includes a biasing element activatable between a first state and a second state, with the biasing element being in the first state when the spittoon mouth is open, and with the biasing element being in the second state when the spittoon mouth is closed.

17. A cleaning system according to claim 16 wherein the biasing element in the first state pushes the first and second moveable platforms apart to open the spittoon mouth, with the first wall section restraining the collapsible wall when the mouth is open, and when the biasing element is in the second state, the collapsible wall is received within the first wall section when the spittoon mouth is closed.

18. A service station according to claim 14 wherein:

inkjet printing mechanism has a chassis that supports a wiper scraper of an absorbent material; and the first appliance comprises a wiper for wiping the printhead as the first servicing operation, with the wiper comprising a blade having two opposing side surfaces and a wiping tip, with the wiper tip contacting the printhead during wiping and the wiper scraper during wiper cleaning, and with at least one of the two opposing side surfaces of the blade having a capillary pathway formed thereon to draw liquid ink residue away from the wiping tip through capillary action.

19. A service station according to claim 14, wherein:

during spitting, a main ink droplet and an ink aerosol by-product are ejected from the printhead; and the spittoon further includes a spit ledge projecting into the mouth when open, with the spit ledge located between the printhead and the catch basin to receive the main ink droplet and ink aerosol by-product ejected from the printhead during spitting, with the spit ledge contoured to expel ink received during spitting into the catch basin.

20. A service station according to claim 19, wherein said collapsible wall has a configuration that allows the collapsible wall to slide over the spit ledge when the spittoon mouth is selectively closed.

21. A service station according to claim 19, wherein the spit ledge projects from a portion of said structure.

22. An inkjet printing mechanism, comprising:

a chassis;

an inkjet printhead supported by the chassis;

a service station having a frame supported by the chassis to selectively service the printhead, with the service station frame defining a spittoon catch basin;

a first appliance supported by the service station frame to perform a first servicing operation; and a spittoon comprising the catch basin and a structure defining a mouth openable to occupy a first region to receive ink ejected from the printhead during a second servicing operation comprising spitting, with said structure including a collapsible wall moveable to selectively close the spittoon mouth; and wherein the first appliance is positionable into the first region previously occupied by the spittoon mouth when open.

23. An inkjet printing mechanism according to claim 22 wherein:

the service station includes first and second moveable platforms;

the first appliance is supported by the second moveable platform; and the spittoon structure includes a first wall section supported by the first moveable platform, with the collapsible wall being supported by the second moveable platform, and with the first and second moveable platforms being separated from each other to open the spittoon mouth and moved toward each other to close the spittoon mouth.

24. An inkjet printing mechanism according to claim 23 wherein the service station further includes a base, and the first and second moveable platforms translate relative to the base.

25. An inkjet printing mechanism according to claim 22, wherein the spittoon further includes a spit ledge projecting into the mouth when open, with the spit ledge contoured to expel ink received during spitting into the catch basin.

26. An inkjet printing mechanism according to claim 25, wherein said collapsible wall has a configuration that allows the collapsible wall to slide over the spit ledge when the spittoon mouth is selectively closed.

27. An inkjet printing mechanism according to claim 25 wherein:

during spitting, a main ink droplet and an ink aerosol by-product are ejected from the printhead; and the spit ledge projects from a portion of said structure into the mouth when open, with the spit ledge located between the printhead and the catch basin to receive the main ink droplet and ink aerosol by-product ejected from the printhead during spitting.

28. An inkjet printing mechanism according to claim 22 wherein the wiper comprises a blade having two opposing side surfaces and a wiping tip, with the wiper tip contacting the printhead during wiping and the wiper scraper during wiper cleaning, and with at least one of the two opposing side surfaces of the blade having a capillary pathway formed thereon to draw liquid ink residue away from the wiping tip through capillary action.

29. A method of servicing an inkjet printhead in an inkjet printing mechanism, comprising the steps of:

moving the printhead into a spitting position adjacent a spittoon mouth;

thereafter, ejecting ink from the printhead through the spittoon mouth and onto a spit ledge;

draining the ejected ink from the spit ledge into a catch basin;

prior to the ejecting step, opening the spittoon mouth by moving a structure;

after the ejecting step, closing the spittoon mouth by collapsing said structure; and moving at least a portion of another printhead servicing appliance into a region previously occupied by the spittoon mouth when open.

* * * * *